United States Patent [19]

Grocke et al.

[11] 4,107,905

[45] Aug. 22, 1978

[54] PROCESS AND ARRANGEMENT FOR THE REMOVAL OF THE PACKING FROM PACKED OBJECTS

[75] Inventors: Diethelm W. K. Grocke; Wilfried Jäger, both of Nuremberg, Fed. Rep. of Germany

[73] Assignee: NUTRO Patentverwertungs- und Maschinenhandels GmbH, Nuremberg, Fed. Rep. of Germany

[21] Appl. No.: 743,838

[22] Filed: Nov. 22, 1976

[30] Foreign Application Priority Data

Nov. 20, 1975 [DE] Fed. Rep. of Germany ..... 2552163

[51] Int. Cl.[2] ..... B65B 43/26

[52] U.S. Cl. ..... 53/3; 53/381 R; 214/315

[58] Field of Search ..... 53/3, 50, 381 R; 83/407, 408, 425, 433; 214/304, 305; 30/2

[56] References Cited

U.S. PATENT DOCUMENTS

| | | | |
|---|---|---|---|
| 3,019,924 | 2/1962 | Krupp et al. | 214/304 |
| 3,022,912 | 2/1962 | Vincent | 214/305 |
| 3,263,843 | 8/1966 | Grahn et al. | 214/305 |
| 3,266,541 | 8/1966 | Kluytenaar et al. | 214/305 X |
| 3,664,530 | 5/1972 | Tagigochi | 214/305 X |
| 3,757,973 | 9/1973 | Lambert et al. | 30/2 X |
| 3,889,442 | 6/1975 | Grahn et al. | 53/3 |
| 3,922,778 | 12/1975 | Aalpoel | 30/2 |
| 3,926,322 | 12/1975 | Scott | 214/305 |

*Primary Examiner*—John Sipos

*Attorney, Agent, or Firm*—Sughrue, Rothwell, Mion, Zinn and Macpeak

[57] ABSTRACT

A rectangular foil packing carrying medicinal bottles is automatically slit vertically along both sides and horizontally both longitudinally and transversely at least on the top as the package is moved through multiple stations on an endless conveyor belt. Horizontally and vertically shiftable spikes carrying cutting elements are swivelable about a horizontal axis in the direction of conveyance of the packing for folding back a foil flap created by the cut between a clamping arragement and the first endless conveyor at a third station to permit the bottles to be moved horizontally from the pack onto a second conveyor in the direction of conveyance of the first conveyor.

9 Claims, 2 Drawing Figures

PROCESS AND ARRANGEMENT FOR THE REMOVAL OF THE PACKING FROM PACKED OBJECTS

FIELD OF THE INVENTION

The invention relates to a process and an apparatus for the removal of the packing objects, especially of a six sided foil packing of a package for bottles, especially of medicinal bottles.

BACKGROUND OF THE INVENTION

Hitherto, the packings of medicinal bottles had been removed essentially by hand, whereby the individual medicinal bottles come into contact with the hands of the personnel and are therefore provided with a considerable number of germs. This represents a potential danger for the patient who makes use of the medicine from corresponding bottles. In order to decrease the number of germs on the bottles, hitherto, expensive rinsing and heating processess have been carried out. Despite this expensive treatment, medicinal bottles however are in no way free of dust or germs, which however is an ever increasing demand of medical and government offices and also of the patients. Beyond that, the removal of the packing by hand involves a considerable expenditure of both personnel and cost.

The task of the invention consists in that the inadequacies of the known processes and apparatus are to be avoided and an economic process and an apparatus of the initially mentioned type is to be created, which make possible a dust and largely germ free removal of objects, especially of medicinal bottles from packages.

SUMMARY OF THE INVENTION

According to the present invention this task is solved in the case of the process of the above mentioned type through the fact that the hexagonal foil packing of a package of bottles is slit open at several cutting lines in such a way, that after folding back of the developing flap of the foil, the bottles located in the remaining foil packaging can be removed from said packing in a horizontal direction. This process is determined especially by the fact that the package of bottles is conveyed through several stations by a first conveyor moveable step by step, in which stations the foil packing is slit open along predetermined cutting lines with the help of automatically controlled cutting elements, in that a flap of the foil developing thereby is folded back in the direction of conveyance of the first conveyor below the conveying plane of the conveyor and is clamped down in its folded back state, and in that the bottles are removed from the remaining foil packing in the direction of transportation of the first conveyor. This process which is carried out completely automatically without any kind of manual operation, is very economical and makes possible an unpacking of medicinal bottles free of dust and largely free of germs without additional rinsing and heating processes for said medicinal bottles. Moreover, complicated lifting arrangements, as used frequently in the status of the known art, are not required because of the advantageous and simple pushing off of the bottles in a horizontal direction. The considerable danger of damage to the bottles connected with the known lifting up of said bottles can be eliminated according to the process of the present invention in the case of which, the bottles remain in a horizontal plane.

An advantageous apparatus according to the invention for carrying out this process is characterized by the fact that a first endless conveyor is provided, that a first guiding arrangement for the package of bottles and a fixed cutting element are provided in a first station, that a second guiding arrangement for the package of bottles, a stop arrangement for the package of bottles or for the first endless conveyor, and vertically and horizontally shiftable cutting elements are provided in a second station. Further, there is provided, a third guiding arrangement for the package of bottles, a shifting arrangement for the package of bottles with a swivelable front and rear flap, disposed above the package of bottles, horizontally suitable cutting elements, horizontally and vertically shiftable spikes swivelable around the horizontal axis in the direction of conveyance of the first conveyor. A clamping arrangement is disposed below the plane of conveyance of the first conveyor, for the purpose of clamping down a folded back foil flap between the clamping arrangement and the first conveyor in a third station. A second conveyor with a swivelable terminal part opposite the end of the first conveyor is provided in the direction of conveyance of said first conveyer. All elements of this apparatus are operated fully automatically, especially by pneumatic means arrangements.

Further characteristics, details and advantages of the invention result from the following description of an embodiment on the basis of the drawing.

DESCRIPTION OF THE PREFERRED EMBODIMENT

Figure 1:
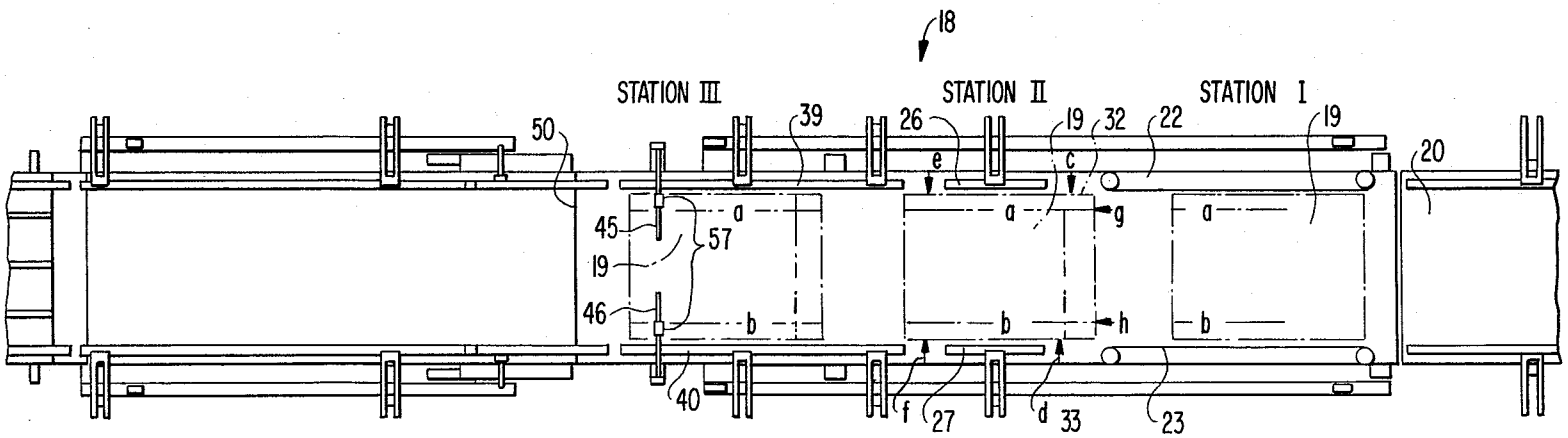
FIG. 1 is a top view of an embodiment of the apparatus according to the invention.
Figure 2:
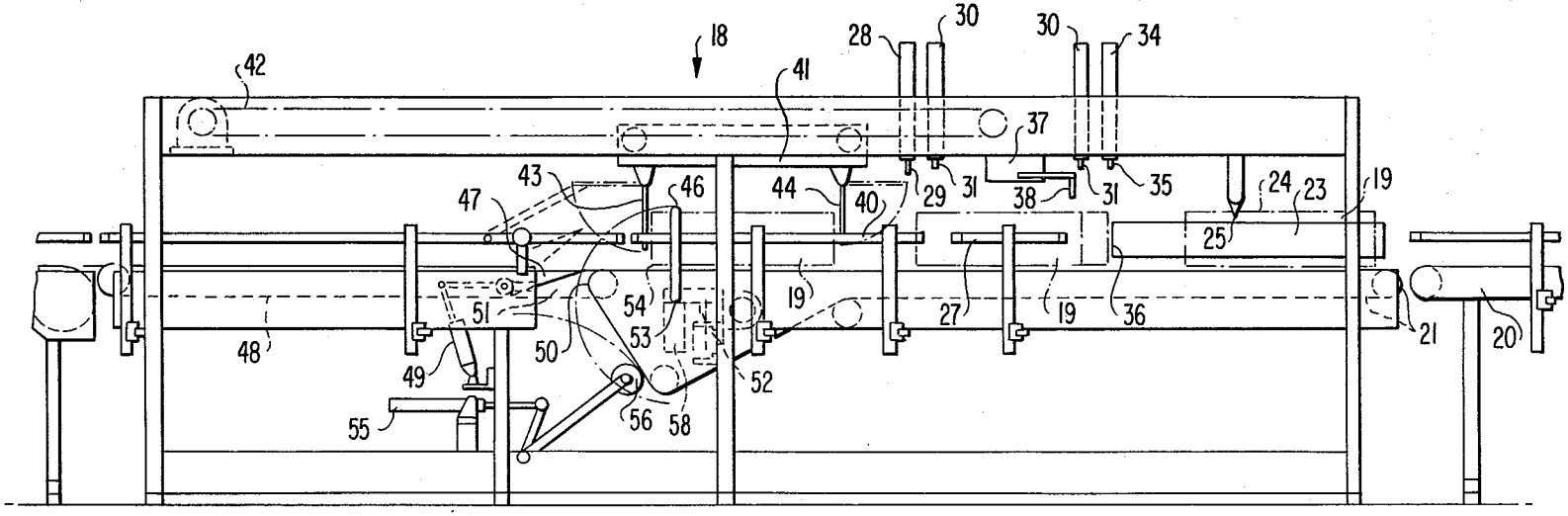
FIG. 2 is a side view of the apparatus shown in FIG. 1, including a few additional elements.

In the FIGS. 1 and 2, a fully automatically operating apparatus 18 for the removal of an hexagonally, that is, rectangular or six sided, shrunk-on foil packing of a bottle package 19 is shown, whereby the bottle package 19 is shown at the same time in temporally successive positions. The bottle package 19 arrives on an endless conveyer belt 20 normally located on the construction side and is transferred to an endless conveyor belt 21. In a first station I, the bottle package 19 is clamped laterally by two belt straps 22, 23, disposed vertically beside the conveyor belt 21, which belt straps run at the same speed as the conveyor belt 21. As the bottle package 19 passes by the first station I, the packing is slit open on its top foil surface 24 with the help of two fixed knives 25 along two horizontal cutting lines *a* and *b* between the two outside lateral rows of bottles (the bottles themselves are not snown in the figures).

In a second station II, the package of bottles 19 is guided by two lateral guide bars 26, 27. The package of bottles 19 runs against a vertical slide 29 shiftable by way of a pneumatically, hydraulically or electrically operable cylinder 28. As a result of that the conveyor belt 21 is stopped, in a second station II, the packing is slit open with the help of four vertically shiftable knives 31 via pneumatically, hydraulically or electrically operable cylinders 30, along four vertical cutting lines *c, d, e,* and *f* within lateral foil surfaces 32, 33, always between the two outside rows of bottles. Two vertically shiftable knives 35 operate via pneumatically, hydraulically or electrically operable cylinders 34, along two vertical cutting lines *g* and *h*, within the rear foil surface 36, always between, for example, the two outside rows of bottles. The packing is slit open at the same time with the help of a horizontally shiftable knife 38 operated via a pneumatically, hydraulically or electrically operable cyclinder 37, along a horizontal cutting line within the upper foil surface 24 between the two rear rows of bottles. In this case, the horizontal cutting line *i* is somewhat displaced on the upper foil surface 24 in the direction of conveyance of the conveying belt 21 with regard to the vertical cutting lines *c* and *d* in the lateral foil surfaces 32, 33. This is to avoid that the cutting line *i* will pass directly over the apertures (openings) of the bottles, placed with a space not shown.

Subsequently, the cylinder 28 moves the slide 29 upwards, as a result of which the conveyor belt 21 is again turned on. The package of bottles 19 is conveyed into a third station III, in which it is guided by two guide bars 39, 40. In the third station III, above the package of bottles 19, a shifting apparatus 41 for the package of bottles 19 is disposed, which is made in the form of a carriage and which can be moved horizontally with the help of a driving arrangement 42. The shifting arrangement 41 has a swivelable front flap 43 and a swivelable rear flap 44, whereby the turned up position of the flaps 43 or 44 has been shown in FIG. 2 in dash dot line.

The package of bottles, whenever the rear flap 44 is turned up, is conveyed into the station III and runs up against the turned down front flap 43 as a result of which the conveyor belt 21 is stopped. Two spikes 45, 46, which are provided with a knife 57 at a distance from the inner end of the spikes, move, in line with the cutting lines *e* and *f*, horizontally from the left and right sides of the conveyor by means 58 below the top foil and between the necks of the bottles of the two foremost rows of bottles and with the put on knives, and they sever the horizontal bridge between the cutting lines *e* and *a* or *f* and *b*. The front flap 43 of the shifting arrangement 41 is turned up and the rear flap 44 is turned down. A terminal part 47 of an endless conveyor belt 48 following the conveyor belt 21 is turned up via pneumatically, hydraulically or electrically operable cyclinders 49 (broken line presentation in FIG. 2), so that, at the front end 50 of the conveyor belt 21, a larger gap 51 develops.

The spikes 45, 46 are raised above the mouths by means 58 of the bottles and are swiveled by means of a pneumatically, hydraulically or electrically operable cylinder 52 around a rotational axis 53 in the direction of the gap 51 (dash dot presentation in FIG. 2). In the case of this swiveling movement of the spikes 45, 46, the foil flap which is limited by the slit open cutting lines *a, b, e, f, i* and the severed bridges (not shown) between the cutting lines *e* and *a* or *f* and *b*, is pulled off the bottom edge 54 of the foremost row of bottles up to the cutting line *i* and is folded back downwards through the gap 51. A swivelable contact roller 56 swivelable via a pneumatically, hydraulically or electrically operable cyclinder 55 is swung out, from left to right, and clamps the turned back foil flap against the conveyor belt 21. The terminal part 47 of the conveyor belt 48 is lowered again (presentation in FIG. 2 in solid lines) and the front flap 43 of the shifting arrangement 41 is again turned down. The spikes 45, 46 move out from the turned down foil flap in a horizontal direction by said means 58 and are swiveled back into their starting position. Now, the conveyor belts 21 and 48 as well as the shifting arrangement 41 will start up. As a result of that, the package of bottles 19 is conveyed onto the conveyor belt 48 with the help of the shifting arrangement 41 while at the same time the remaining foil packing is pulled downwards through the remaining small gap between the terminal part 47 of the conveyor belt 48 and the end 50 of the conveyor belt 21. Subsequently, the flaps 43 and 44 are turned up and the shifting arrangement 41 returns into its starting position. The exposed bottles are now conveyed on the conveyor belt 48 for example to a filling station.

The apparatus 18 should be set up in airconditioned, dust free and largely germ free rooms in order to make possible a germ free unpacking and filling of the medicinal bottles from this point of view too.

We claim:

1. A process for the removal of a rectangular foil packing including top, bottom, front, rear and side walls of a package of bottles comprising the steps of:

conveying the package of bottles through several stations on a first horizontal conveyor, step by step, slitting said foil packing along predetermined cutting lines by automatically controlled cutting apparatus to develop along said cutting lines a foil flap at the top and front of the packing, turning back said foil flap under the bottom of said foil packing in the direction of transport of said horizontal conveyor, below the conveying plane of said conveyor, clamping down said turned back foil flap beneath the conveying plane of said horizontal conveyor, and removing bottles horizontally from the remaining foil packing in the direction of conveyance movement of said horizontal conveyor.

2. The process as claimed in claim 1, wherein said foil packing slitting step comprises slitting open said foil pack in a first step along two longitudinally horizontal cutting lines on the upper foil surface and between two outside lateral rows of bottles during movement of said pack on said horizontal conveyor through said first station, and wherein said conveying step comprises stopping said horizontal conveyor automatically at a second station downstream of said first station and said slitting step further comprises slitting open the foil packing in said second station along four vertical cutting lines within the lateral foil surfaces on both vertical sides of said packing and between the two outside rows of bottles, and along two vertical cutting lines within the rear wall of said packing and between the two outside rows of bottles and simultaneously along a transverse horizontal cutting line on the upper foil surface between the two rear rows of bottles, and wherein said conveying step further comprises automatically, subsequent to said slitting steps at said second station, conveying of said package to a third station, and wherein said slitting step further comprises slitting open said foil packing laterally at said third station between the two front rows of bottles along a horizontal bridge on the upper foil surface between a horizontal cutting line slit open at the first station and a vertical cutting line slit open at the second station, between the two front rows of bottles, to form said foil flap.

3. The process as claimed in claim 2, wherein said step of slitting said foil packing along a horizontal cutting line in said second station comprises effecting a lateral horizontal cutting line which is offset longitudinally relative to the vertical cutting line of lateral foil surfaces between the two rear rows of bottles.

4. The process as claimed in claim 2, wherein said step of turning back said foil flaps comprises pulling off the flap up to the edge of the bottom of the foremost row of bottles up and to the transverse horizontal cutting line slit within said foil packing by inserting multiple spikes which are guided below the foil flaps between the two front rows of bottles, lifting them above the mouths of the bottles and swivelling them forwardly, and to turn said foil flap downwardly through a large gap at the front end of the conveyor, moving the spikes out of the turned down back foil flap, and thereafter reducing the size of the gap at the front end of the horizontal conveyor and said conveying step further comprises again initiating movement of said horizontal conveyor to cause the package of bottles to be conveyed forward with the remaining foil packing being pulled through the small gap, downwardly between the horizontal conveyor and said clamping means.

5. An apparatus for removing a rectangular foil packing of a package of bottles from said bottles, said apparatus comprising:

a first endless, horizontal conveyor, first lateral guide means for guiding the package of bottles through a first station on said first endless, horizontal conveyor, fixed cutting means provided at said first station for overlying said rectangular packing and for severing the foil packing along the upper surface of said packing as said package moves therethrough, second lateral guide means for said package of bottles downstream of said first guide means and defining a second station along said first endless horizontal conveyor, means for stopping said package of bottles at said second station, vertically and horizontally shiftable cutting means provided at said second station for cutting slits within said foil packing along the vertical sides, the vertical rear and the top of said foil packing at said second station, third guide means downstream of said second guide means along said first endless, horizontal conveyor defining a third station, shifting means disposed above said first endless, horizontal conveyor at said third station and including swivelable front and rear flaps to arrest the movement of said package, means for swivelling said front and rear flaps, horizontally and vertically shiftable spikes including cutting means for slitting horizontally the top of said foil packing to thereby form with said slits a foil flap, said spikes are mounted for rotation about a horizontal axis at said third station and in the direction of conveyance of said first conveyor for turning back said foil flap, and clamping means at said third station and disposed below the plane of conveyance of said first conveyor for clamping a turned back foil flap between the clamping means and said first conveyor below the plane of conveyance of the first conveyor, a second horizontal conveyor with a swivelable terminal part positioned opposite the end of the first conveyor is provided in the direction of conveyance, and means for operating said first endless conveyor intermittently in a direction such that said package of bottles moves sequentially through said first, second and third stations;

whereby, subsequent to turning back of said foil flap beneath the plane of conveyance of said first conveyor, said bottles may be movable forwardly, horizontally by said first conveyor and away from said first conveyor onto said second horizontal conveyor to separate said bottles from said rectangular foil package.

6. The apparatus as claimed in claim 5, wherein said first guide means comprises belt straps disposed vertically and positioned laterally on both sides of said first conveyor and said second and third guide means comprises laterally opposed guide bars disposed at said second and third stations above said first endless conveyor.

7. The apparatus as claimed in claim 5, further comprising pneumatically shiftable/means for said cutting means at said second station, and wherein said stop means at said second station comprises a vertically shiftable slide.

8. The apparatus as claimed in claim 5, wherein said shifting means at said third station is shiftable both in the same direction and counter to the direction of transport of said package of bottles on said first endless horizontal conveyor, said means for shifting said flaps comprise pneumatic means and wherein said cutting means at said third station are fixedly disposed on said spikes at a distance from the transverse inner ends of said spikes.

9. The apparatus as claimed in claim 5, wherein said clamping means comprises a contact roller swivelably rotatable about a horizontal axis towards and away from said first endless horizontal conveyor.

* * * * *